US009752335B1

(12) United States Patent
Tian

(10) Patent No.: US 9,752,335 B1
(45) Date of Patent: Sep. 5, 2017

(54) UNIVERSAL CONCRETE FOUNDATION OR SLAB FORMS BRACKET

(71) Applicant: Jiaxing Tian, Sunnyvale, CA (US)

(72) Inventor: Jiaxing Tian, Sunnyvale, CA (US)

( * ) Notice: Subject to any disclaimer, the term of this patent is extended or adjusted under 35 U.S.C. 154(b) by 0 days.

(21) Appl. No.: 15/233,832

(22) Filed: Aug. 10, 2016

(51) Int. Cl.
*E04G 17/02* (2006.01)
*E02D 27/01* (2006.01)
*E04G 17/00* (2006.01)

(52) U.S. Cl.
CPC ..... *E04G 17/001* (2013.01); *E02D 27/013* (2013.01); *E04G 17/02* (2013.01); *E02D 2250/0023* (2013.01)

(58) Field of Classification Search
CPC ..... E02D 27/013; E04G 17/14; E04G 17/001; E04G 17/02; E04G 17/04
USPC ..... 403/230, 233, 205, 403, 232.1, 231; 249/3, 4, 6, 8
See application file for complete search history.

(56) References Cited

U.S. PATENT DOCUMENTS 1,029,674 A * 6/1912 Dunagin ..... E01C 19/506 249/21
1,243,713 A * 10/1917 Colarusso ..... E01C 19/506 249/4
1,708,634 A 4/1929 Rees
1,781,601 A 11/1930 Rohaut et al.
1,799,505 A 4/1931 Feldblet
3,327,986 A * 6/1967 Oury ..... E04G 17/02 249/191
3,411,743 A 11/1968 Hawkins
3,579,938 A 5/1971 Hanson
3,596,941 A * 8/1971 Tracy ..... E04B 1/2608 403/190
3,894,374 A * 7/1975 Faucheux ..... E04B 1/185 52/250
3,989,398 A * 11/1976 Wendt ..... E04B 1/2612 403/230
4,181,292 A * 1/1980 Hubel ..... E01F 13/02 108/108
4,477,980 A * 10/1984 Jukes ..... E04G 17/14 33/286
4,494,725 A 1/1985 Sims
D290,223 S * 6/1987 Westerheim ..... 403/232.1
5,274,981 A * 1/1994 Commins ..... E04B 1/2608 403/232.1
5,562,272 A * 10/1996 McAbee ..... E01C 19/502 249/192
5,830,378 A 11/1998 Butler
6,378,819 B1 * 4/2002 Johnson ..... B60R 9/06 24/525
8,132,774 B1 * 3/2012 Whatcott ..... E01C 19/502 249/34
8,720,839 B2 * 5/2014 Lijesnic ..... A47B 47/0033 248/300
2003/0111585 A1 * 6/2003 Hufnagel ..... E01C 19/502 249/3
2009/0272873 A1 11/2009 Fitler

FOREIGN PATENT DOCUMENTS

DE 2348943 * 4/1974 ..... E04B 1/185

* cited by examiner

*Primary Examiner* — Michael Safavi
(74) *Attorney, Agent, or Firm* — Robert Brownstein

(57) ABSTRACT

The system herein disclosed and claimed is a system for positioning and adjusting wooden concrete forms.

3 Claims, 8 Drawing Sheets

UNIVERSAL CONCRETE FOUNDATION OR SLAB FORMS BRACKET

TECHNICAL FIELD

This invention is associated with building construction components.

BACKGROUND OF THE INVENTION

In construction of buildings and dwellings it is common for concrete foundations and/or slabs to be required.

Before concrete is poured, it is essential that wooden forms are placed and adjusted such that the foundation or slab will be located in the correct position, the upper surface of the concrete will be level and corners are precisely squared.

The method by which one assures that the foregoing conditions are met is a multifaceted one. Before the forms are to be put in place, one has to establish the outline in which they will be placed while ensuring that the angles are accurate within measurement limits and that a level plane is mapped out such that the wooden forms will meet at the correct angles, and their top edges will from a level plane.

One facet of the method, then, involves locating wooden batter boards and their frames beyond the anticipated corners of the foundation or slab. Using a mason's line, the outline of the forms upper edges is carefully mapped out such that precise angles are present at the corners, and the mason's lines are all level. As such, the ends of the mason's lines are attached to the batter boards, and then adjusted for proper angle and height. This is often a lengthy first part of the method. In addition, each batter board and frame comprises five separate pieces of wood, requiring at least 20 for a four-cornered foundation or slab.

Once the outline has been mapped out using the batter boards, the forms are typically put in place based on the positions of the mason's lines. This, too, is a lengthy process that may require repositioning the wooden forms laterally and vertically. The forms are held in place using wooden stakes and supports, and each time a form must be moved, it must be detached from and reattached to one or more supports.

It is not uncommon for a foundation or slab to require hours or even days of multi-person labor to properly position and adjust the forms before the concrete can be poured.

BRIEF SUMMARY OF THE INVENTION

The invention herein disclosed and claimed is a one-person system for positioning and adjusting wooden forms.

One system device replaces the batter board and frame with a single tool that can be used to quickly lay out the mason's lines for accurate corner angles and level plane. Unlike the wooden batter board and frame, this tool can be used and reused again and again.

Once the lines are drawn, so to speak, another system tool is used to hold the wooden forms in place while allowing them to be adjusted laterally and vertically without having to use a multitude of support stakes and forms that require laborious attachment and reattachment as forms are repositioned.

The bracket tool for forms positioning and adjustment can be mounted temporarily along the lines determined using the batter tool, allowing the forms to be placed in the u-shaped channels, then adjusted laterally and vertically without having to first attach them to the tool.

Only after the forms have been accurately positioned and adjusted will one then mount the stakes and supports that will hold the forms firmly in place during the concrete pour. After having placed those stakes and supports, one can easily remove the bracket tools, which can be reused, again and again.

The system invention reduces the amount of wood needed for mason's lines procedure, and the bracket tool reduces the number of people and time required for positioning and adjusting the forms. In fact, the system will enable a single person to position and adjust the wooden forms. As such, it has the potential of reducing costs and times for foundation and slab construction.

BRIEF DESCRIPTIONS OF THE DRAWINGS

Figure 5A:
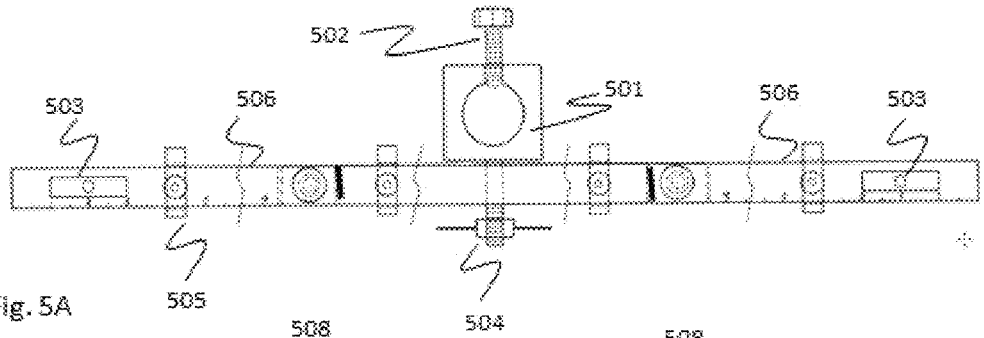

FIG. 5A (top view) and 5 B (side view) is one embodiment of the batter system tool disclosed and claimed.

Figure 6A:
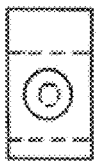
Figure 6B:
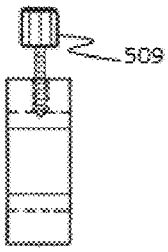
Figure 6C:
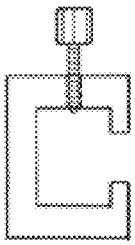

FIG. 6A (top view), 6B (side view), 6C (side view) is one embodiment of the sliding clamps used to position and reposition the mason's line for proper angle and level plane.

Figure 7:
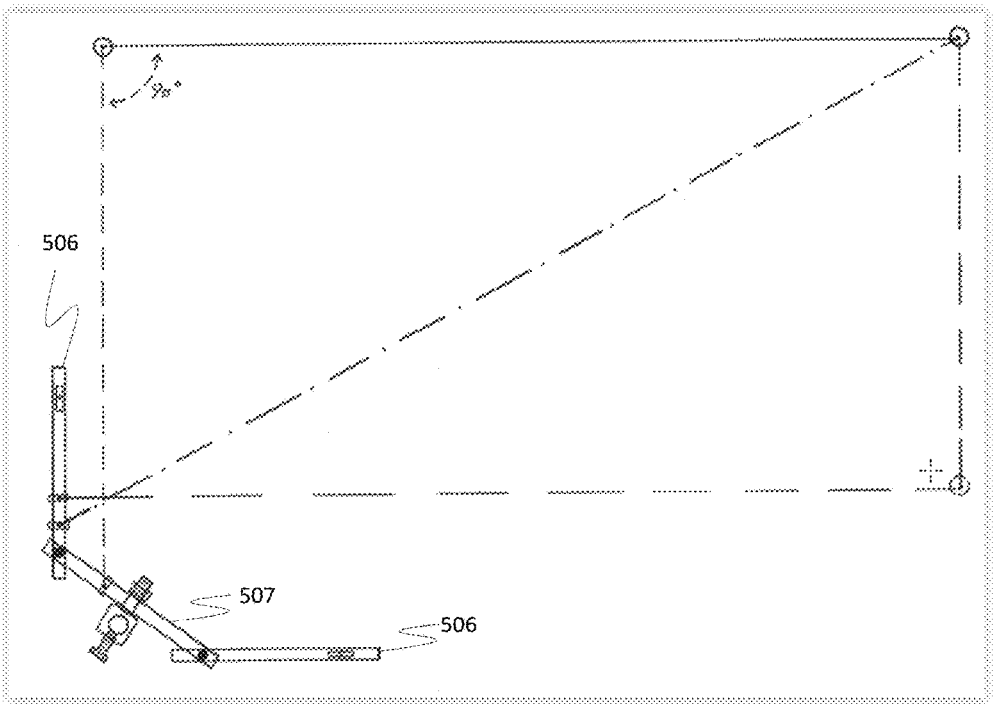

FIG. 7 shows one such batter system (as in FIG. 5) in place.

Figure 8:
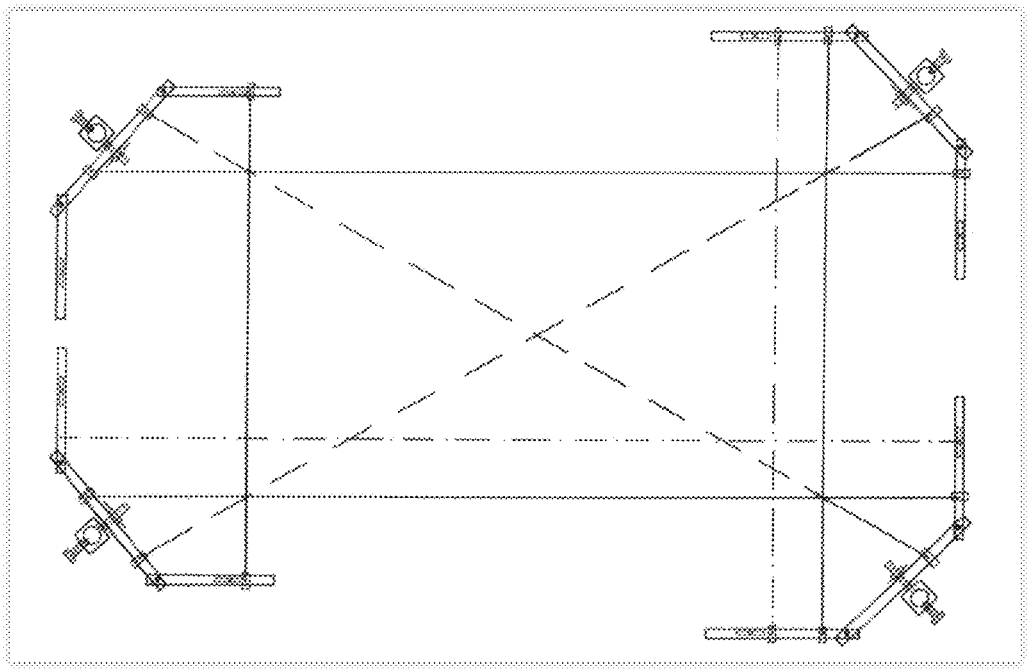

FIG. 8 shows four such batter systems (as in FIG. 5) in place.

Figure 9:
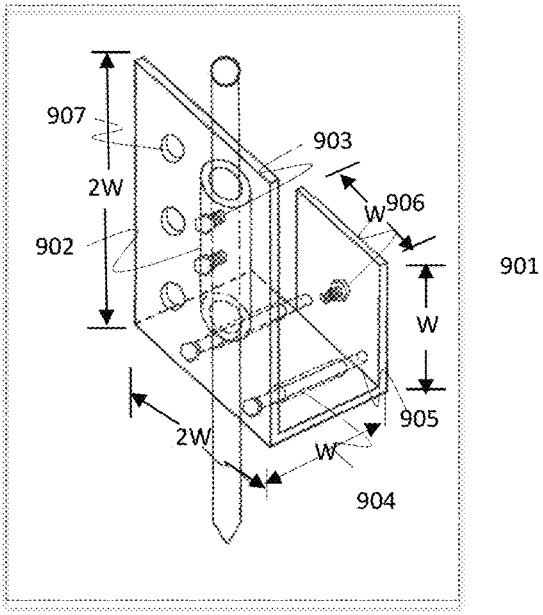

FIG. 9 depicts one embodiment of the universal forms bracket invention.

Figure 10:
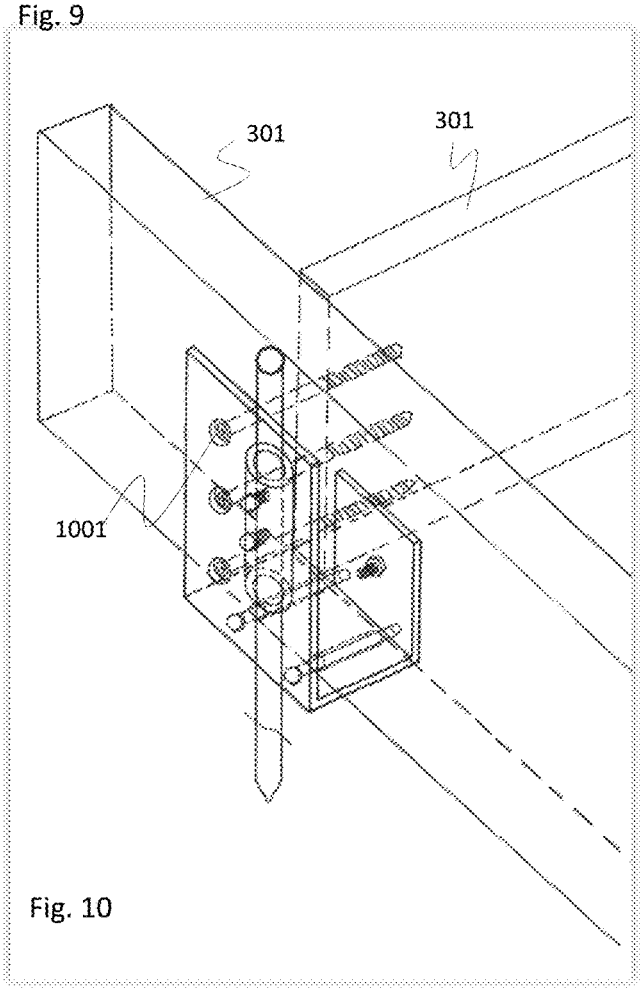

FIG. 10 depicts an exemplary view of how the tool in FIG. 9 is applied.

Figure 11:
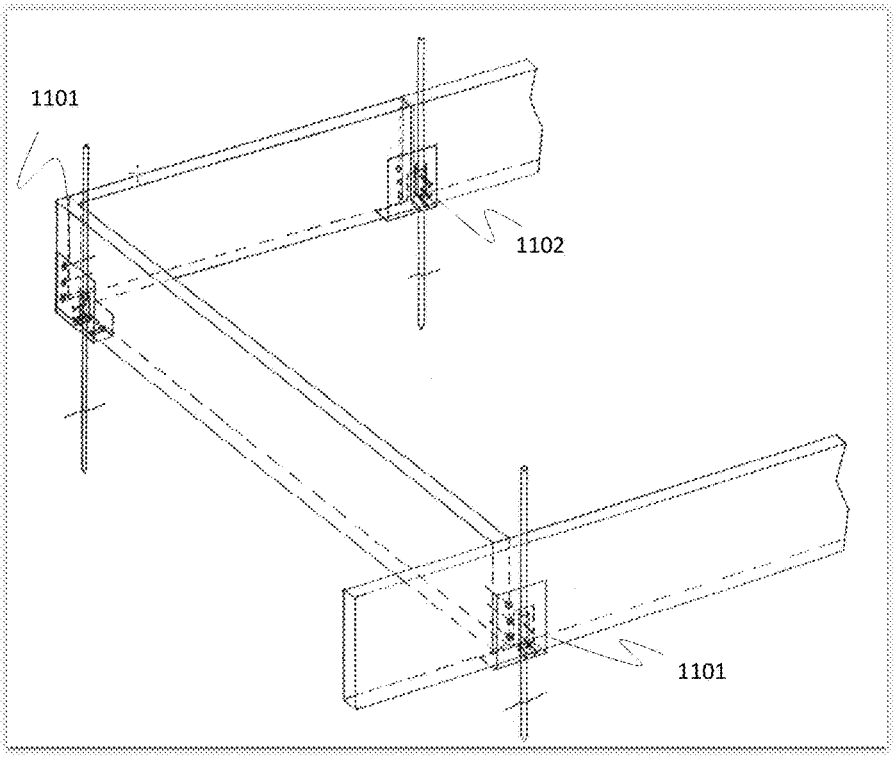

FIG. 11 depicts an exemplary view of the tool in FIG. 9 applied to mutually perpendicular forms.

Figure 12:
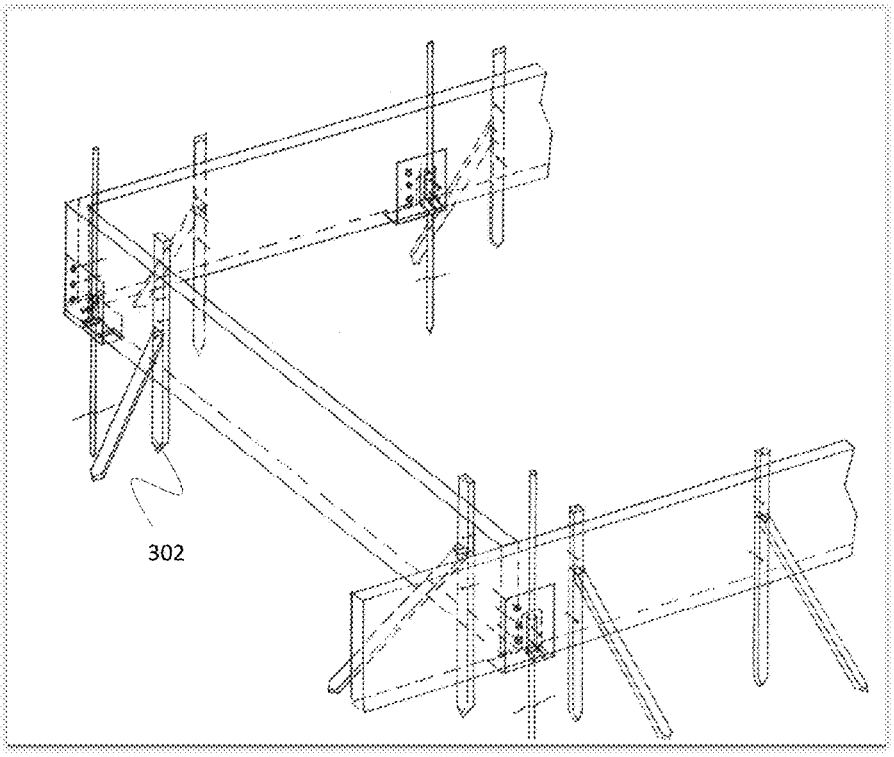

FIG. 12 illustrates the installment of wooden stakes and supports once the wooden forms have been properly place and adjusted.

Figure 13:
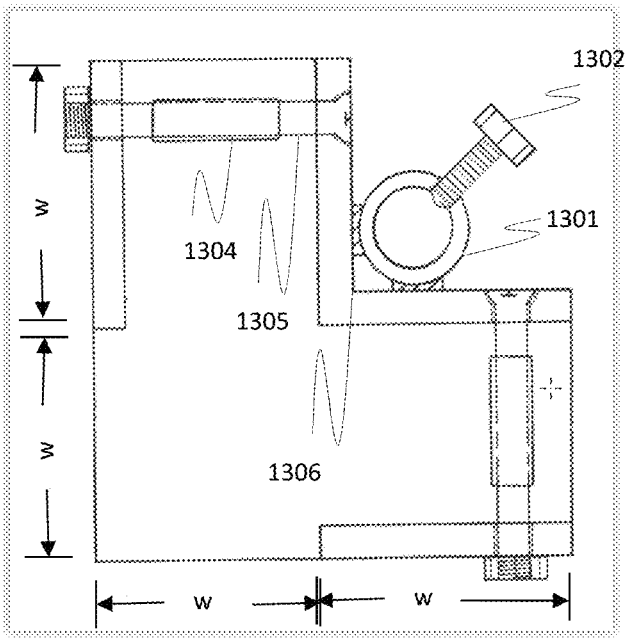

FIG. 13 depicts one embodiment of a corner forms bracket from a top view.

Figure 14:
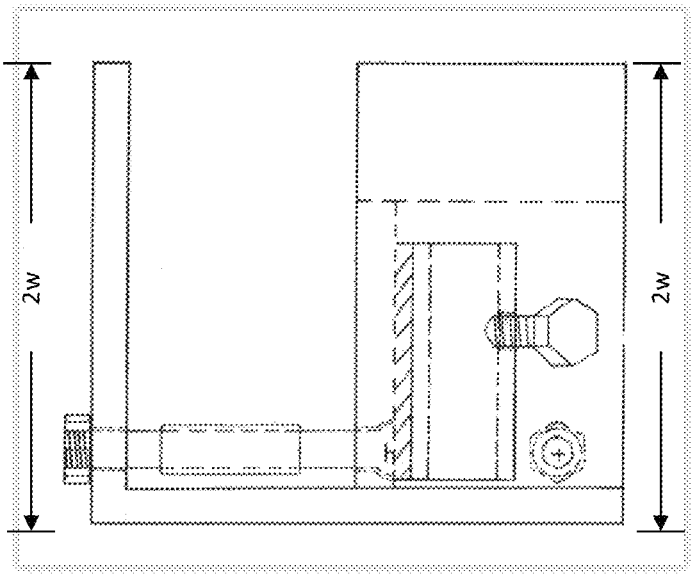

FIG. 14 depicts the item in FIG. 13 from a side view.

Figure 15:
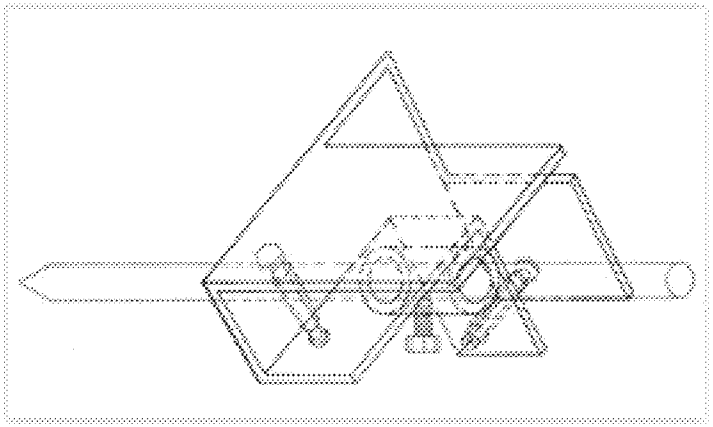

FIG. 15 depicts the corner bracket in a three-dimensional view.

Figure 16:
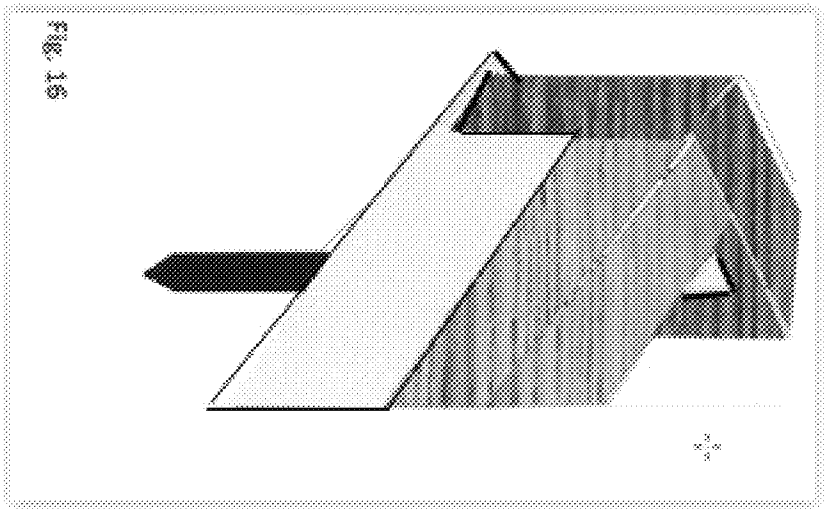

FIG. 16 illustrates how the item in FIG. 15 is applied.

DETAILED DESCRIPTION OF THE INVENTION

It is common when constructing a building or dwelling to construct a concrete foundation or slab.

The pouring of the concrete is relatively quick and irreversible. Hence, it is critical that the forms around which the concrete will be poured are positioned and adjusted precisely. Therefore, the procedures surrounding the positioning and adjusting of forms often eclipses the actual concrete pour in terms of both time and cost.

Two essential conditions have to be met by the wooden forms. The corners need to be square and the upper edges of the forms should lie in a level plane.

Figure 1:
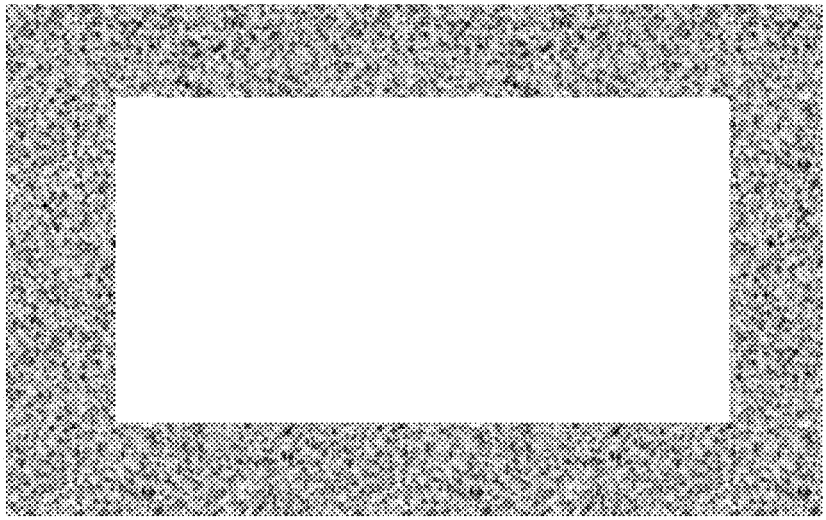
FIG. 1 depicts an exemplary concrete foundation from a top view.
Figure 2:
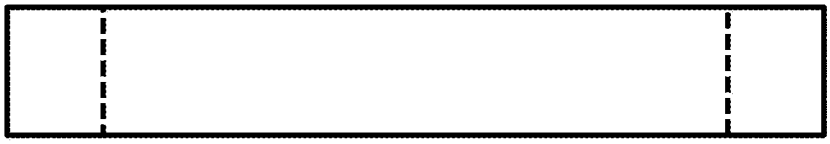
FIG. 2 depicts the exemplary foundation from FIG. 1 in a side view.

In FIG. 1, a concrete foundation is viewed from the top. FIG. 2 shows a side view.

Figure 3:
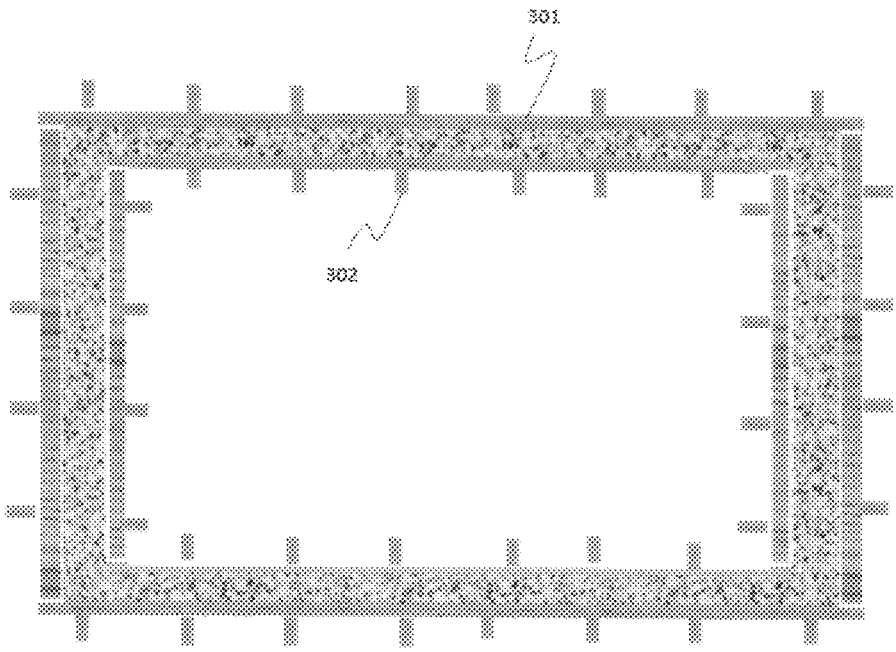
FIG. 3 is an exemplary view of the wooden forms and supports that are used to enclose the spaces wherein the concrete is poured to construct the foundation.

To prepare for the concrete pour for such a foundation, one needs to place and position forms creating an outer rectangular perimeter, and an inner rectangular perimeter. In FIG. 3, the forms (301) are usually supported by stakes and supports (302) to keep them vertical and relatively immobile. A concrete slab (not shown) would require just one rectangular perimeter.

Figure 4:
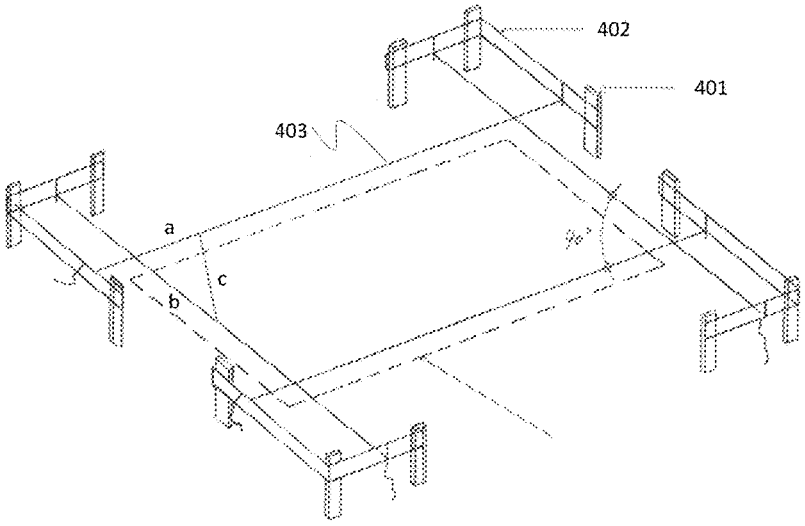
FIG. 4 depicts a typical batter board arrangement used to establish the outline for wooden forms placement.

FIG. 4 shows how one uses batter boards for mapping out the positions of wooden forms. The batter boards (402) and the vertical support stakes (401) are positioned beyond the anticipated corners of the foundation or slab. Mason's lines (403) are then tied to the batter boards to create a first approximation of form position. The ends of the mason's lines are typically moved laterally along a batter board until the projected outline of the slab has the proper dimensions and corner angles. In this case, the corner angles are all 90 degrees. An accurate way to determine if the angle is correct is to use the Pythagorean right-angle formula ($c^2=a^2+b^2$). If the hypotenuse (c) of the triangle is measured from a point 3 feet along one leg (a) and 4 feet along the other leg (b), the resulting measurement should be exactly 5 feet. If not, then the mason's lines have to be moved until one gets an accurate measure. Once the perimeter lines are correct, one can place lines between opposite corners of the rectangle and using a plumb bob determine if the plane formed by those lines is level. The perimeter lines then become the outline for wooden form positioning.

Figure 5B:
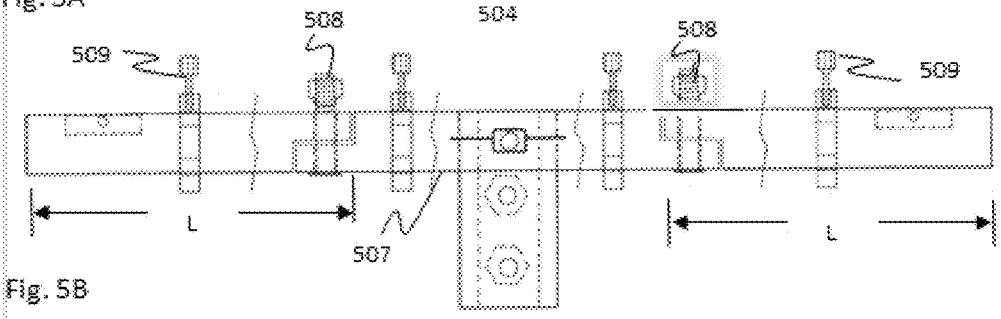

FIG. 5 shows one embodiment of the batter system tool. This tool effectively replaces the five wooden parts of the batter board with a single tool that mounts on a stake driven into the ground surface. FIG. 5 shows a top view and side view of the batter system tool. An anchor portion (507) has a stake sleeve (501) that allows a stake driven into the ground to pass through it. A screw (502) tightens the stake sleeve against the stake once it is in the approximate vertical position. Another screw (504) allows the anchor portion and its two side portions (506) to be rotated in a vertical plane until the levels (503) embedded in the side portions show it is level. The side portions (506) are connected to the ends of the anchor portion (507) allowing them to be rotated in a horizontal plane. Once rotated into the desired position, the side portions can be locked in position using the attachment screw (508). The anchor portion length, L, is the same as the lengths of the side portions. L should be at least 18 inches. The mason's lines are attached to sliding clamps (505) that are free to move laterally along the side portions and the anchor portion. Once positioned in the desired spot, they can be locked in place with screw 509. The mason's lines attach to screw 509. By adjusting the sliding clamps and side portions, one can obtain the proper angles at the corners of the mason's lines, and the levels indicate that the lines originating from that batter system tool are level, too. Finally, to assure that the plane is level, one can run lines diametrically across the perimeter lines and use a plumb bob to verify it. Each batter system tool replaces the five batter system boards, and moving the mason's lines is easier using the sliding clamps than having to tie and untie the ends on a batter board.

FIG. 7 shows one batter system tool in place at one corner. As shown, two sliding clamps on the side portion 506 are used to anchor two mason's lines. One will be used to establish a perimeter side and the other will run diametrically across.

FIG. 8 shows four batter system tools in place with solid-line mason's line depictions establishing the perimeter positions and doted-line mason's lines crossing over the perimeter lines. Where the dotted lines crisscross one another, one can use a plumb bob to verify the perimeter plane is level. If not, one can adjust the height of the batter system tool using the stake-sleeve and screw.

Once the perimeter outline is complete, one can begin placing the universal form brackets along the projected perimeter lines on the ground surface. The universal form brackets form a u-shaped channel into which the bottom edge of a form will be supported. As such, the width, w, of the u-shaped channel will be at least the width of the wooden form plus some fraction of that width greater to allow for smooth lateral motion through the channel. The height of the large side of the bracket is essentially equal to 2 w. The height of the small side is essentially equal to w. A stake sleeve (902) and screw (903) enables the bracket to be positioned vertically along a stake driven into the ground surface. Roller structures (904) that rotate around axles (905) enable wooden forms to easily slide horizontally along the u-shaped channel. The screw (906) in the small side can be used to position the form along a line perpendicular to the rollers.

As shown in FIG. 10, at the corner, two wooden form boards (301) meet at approximately 90 degrees and once the positions are as desired, one or more screws (1001) can be driven through both boards (as shown) and the one or more holes in the large side of the bracket thereby securing them firmly in place.

FIG. 11 shows three universal bracket tools in place, two at corners (1101) and one along a forms line (1102). The two brackets at the corners can be used to firmly join the boards once positioned as desired, and the bracket (901) can be used to join two form boards, end to end, by using the one or more screw holes (907).

In FIG. 12, once the boards are positioned and adjusted, wooden support stakes (302) can be put in place to hold the forms in position and vertically rigid. The bracket tools can then be removed leaving the forms in place for the pouring of the concrete.

FIG. 13 shows another embodiment of the forms bracket, a corner bracket, that features two u-shaped channels at right angles to one another. The width, w, of each channel is at least the width of a wooden form plus some fraction of that width to allow smooth lateral motion through the channel. The height of the sides is essentially equal to w. One or more rollers (1304) are held in place by screws (1305) in each channel to allow for lateral form movement during adjustment. A stake sleeve (1301) and screw (1302) provide for mounting of the corner brackets on a stake driven into the ground surface allowing it to be locked into a desired vertical position by tightening screw 1302. The stake sleeve is located at the apex (1306), flush against the sides as shown.

FIG. 14 shows a side view of the corner bracket from FIG. 13.

FIG. 15 shows a three-dimensional view of the corner bracket from FIG. 13.

FIG. 16 shows the corner bracket with two wooden forms meeting at the corner.

In combination, the batter system tool and universal bracket tool support the accurate layout of concrete foundation or slab followed by the quick positioning and adjustment of the wooden forms in advance of a concrete pour. They are viewed as a system because they support all the preparatory steps leading up to a concrete pour for a foundation or slab. The batter system tool replaces the five wooden elements of a contemporary batter board and frame, and the sliding clamps make adjustment of the mason's line more precise and fast compared to a batter board setup. The universal forms bracket supports the positioning and adjustment of the wooden forms up to final position. Because the forms do not have to be attached to the brackets during position and adjustment, it takes fewer people and less time to position and adjust the boards. The system comprising the batter system tool and universal form bracket tool can reduce the time and cost of concrete foundation and slab construction.

The corner forms bracket as part of the system is optional. It can be used to provide a solid support at the corners of the forms perimeter.

The batter system tool, universal bracket tool, and corner bracket tool should be made of metallic material to ensure sufficient strength and rigidity. Although rollers are disclosed and claimed, roller ball type fixtures could also be used on the base portions to allow easy lateral movement.

What is claimed is:

1. A universal forms bracket comprising:

a large side, essentially square shaped;

a small side, essentially square shaped;

a base, essentially rectangular, having two opposite long base edges and two opposite short base edges;

said large side, said small side and said base form a u-shaped channel with said base essentially horizontally oriented at the bottom, said large side and said small side vertically oriented and extending upward from said base;

said large side is located along one of said two opposite long base edges such that one horizontal large side edge meets said one of said two opposite long base edges with the large side essentially perpendicular to the base;

said small side is located along the other of said two opposite long base edges such that one horizontal small side edge meets said other of two opposite long base edges with the small side essentially perpendicular to the base;

one vertical large side edge is coplanar with one of said two opposite short base edges;

the other said vertical large side edge is coplanar with the other of said two opposite short base edges;

one vertical small side edge is coplanar with one of said two opposite short base edges;

the length of said small side edges are essentially equal to the length of said short base edges;

the length of said large side edges are essentially equal to twice the length of said short base edges;

a stake sleeve attached to said large side, opposite the said u-shaped channel, oriented parallel to said vertical large side edges and located essentially half-way between said vertical large side edges;

at least one screw oriented perpendicular to said stake sleeve, passing through said stake sleeve, and operative to tighten said stake sleeve to the side of a stake passing through said stake sleeve.

2. A claim as in claim 1 further comprising:

at least one roller structure, located parallel to and above said base, and parallel to said short base edge, operative to roll allowing low-friction lateral movement of an object in said u-shaped channel.

3. A claim as in claim 1 further comprising:

at least one through hole in said large side operative to allow a screw to pass through it;

said at least one through hole located essentially half-way between said stake sleeve and said vertical large side edge located diametrically opposite from said vertical small side edge that is coplanar with said short base edge.

* * * * *